US008256435B2

(12) United States Patent
Croes-Stoffer

(10) Patent No.: US 8,256,435 B2
(45) Date of Patent: Sep. 4, 2012

(54) HAIR EXTENSION ELEMENT, METHOD FOR INSTALLING IT AND HOLDING MEMBER

(76) Inventor: Silvia Croes-Stoffer, Ar Purmerend (NL)

( * ) Notice: Subject to any disclaimer, the term of this patent is extended or adjusted under 35 U.S.C. 154(b) by 316 days.

(21) Appl. No.: 12/448,204

(22) PCT Filed: Nov. 8, 2007

(86) PCT No.: PCT/EP2007/062075

§ 371 (c)(1),
(2), (4) Date: Jul. 23, 2009

(87) PCT Pub. No.: WO2008/071505

PCT Pub. Date: Jun. 19, 2008

(65) Prior Publication Data

US 2010/0006115 A1 Jan. 14, 2010

(30) Foreign Application Priority Data

Dec. 13, 2006 (NL) ..... 2000370

(51) Int. Cl.
*A41G 5/00* (2006.01)

(52) U.S. Cl. ..... 132/54

(58) Field of Classification Search ..... 132/53–55, 132/201, 275; 63/33, 43
See application file for complete search history.

(56) References Cited

U.S. PATENT DOCUMENTS 5,097,854 A 3/1992 Smith
5,810,022 A * 9/1998 Reynolds ..... 132/200
5,881,736 A * 3/1999 Turner et al. ..... 132/200
6,314,969 B1 * 11/2001 Lacause ..... 132/275
6,425,405 B1 7/2002 McRoberts
6,938,624 B2 * 9/2005 Arroyo et al. ..... 132/201
7,614,403 B2 * 11/2009 Nomura ..... 132/201
2001/0050090 A1 * 12/2001 Neary ..... 132/275
2002/0185146 A1 * 12/2002 Gold ..... 132/201
2003/0234027 A1 12/2003 Smith
2004/0149302 A1 * 8/2004 Toda ..... 132/201
2004/0173233 A1 * 9/2004 Tokko ..... 132/201

(Continued)

FOREIGN PATENT DOCUMENTS

DE 19543917 A1 5/1997

(Continued)

OTHER PUBLICATIONS

International Search Report. International Application No. PCT/EP2007/062075. Date of the actual completion of the international search: Jun. 19, 2008.

(Continued)

*Primary Examiner* — Todd Manahan
*Assistant Examiner* — Jennifer Gill
(74) *Attorney, Agent, or Firm* — Schwegman Lundberg & Woessner, P.A.

(57) ABSTRACT

A hair extension element for extending a strand of hair is securable to the strand of hair through a flexible holding member. The holding member comprises a through hole for guiding and clamping the strand of hair. The holding member and the hair extension element are integrated so as to provide the hair extension element as an integrated part to the strand of hair. Furthermore a holding member which is provided with at least an ornament comprises at least two through holes extending substantially parallel to each other for guiding strands of hair there through. A holding member comprising at least one through hole is provided with at least two ornaments on its outer side.

4 Claims, 2 Drawing Sheets

U.S. PATENT DOCUMENTS

| | | | | |
|---|---|---|---|---|
| 2005/0081873 | A1 | 4/2005 | Chung | |
| 2005/0268932 | A1* | 12/2005 | Gold | 132/201 |
| 2006/0027244 | A1* | 2/2006 | Nomura | 132/201 |
| 2006/0065280 | A1* | 3/2006 | Cheung | 132/201 |
| 2008/0276949 | A1* | 11/2008 | Lee | 132/53 |

FOREIGN PATENT DOCUMENTS

| | | | |
|---|---|---|---|
| FR | 2765080 | A1 | 12/1998 |
| GB | 2372207 | A | 8/2002 |
| JP | 2004-027402 | * | 1/2004 |
| WO | 2005027670 | A1 | 3/2005 |
| WO | 2005044031 | A1 | 5/2005 |
| WO | 2005044033 | A1 | 5/2005 |
| WO | 2005074743 | A2 | 8/2005 |
| WO | 2006020176 | A2 | 2/2006 |
| WO | 2006106412 | A1 | 10/2006 |

OTHER PUBLICATIONS

International Preliminary Report on Patentability. International Application No. PCT/EP2007/062075. Date of issuance of the report: Jun. 16, 2009.

Office Action for corresponding European Application No. 07 822 377.3, dated Jun. 11, 2010.

Office Action for corresponding European Application No. 07 822 377.3, dated Jul. 1, 2010.

Office Action for corresponding European Application No. 07 822 377.3, dated Mar. 28, 2011.

* cited by examiner

HAIR EXTENSION ELEMENT, METHOD FOR INSTALLING IT AND HOLDING MEMBER

CROSS-REFERENCE TO RELATED APPLICATIONS

This application is a National Phase application of International Application No. PCT/EP2007/062075, which was filed on Nov. 8, 2007, and titled "HAIR EXTENSION ELEMENT, METHOD FOR INSTALLING IT AND A HOLDING MEMBER". The entire content of this application is incorporated herein by reference.

BACKGROUND

The present invention relates to a hair extension element for extending a strand of hair.

Hair extension elements are known from WO 2005/044033, for example. That document discloses a hair extension element which is adapted such, that before installing it on a strand of hair a flexible holding member is stringed to the strand of hair first. In order to achieve that, the strand of hair is guided through a through-hole of the holding member. Subsequently an insertion body corresponding to the hole is clamped in the hole at the side of the holding member from which an end portion of the strand of hair projects. Prior to this the insertion body has been attached to the hair extension element. A disadvantage of the known hair extension element is the rather complex method of installing it into the hair.

SUMMARY

The object of the invention is to provide a hair extension element which can be installed in a simpler way.

The object is achieved with the hair extension element according to the invention which is characterized in that the holding member and the hair extension element are integrated. As a consequence, the hair extension element can be installed on the strand of hair as an integrated element. Due to these features only the stringing action has to be performed in order to install the hair extension element on a strand of hair and secure it thereto, which means that the user may install the hair extension element to the hair more quickly.

The hair extension element may be guided through the through-hole and fixed with respect to the holding member by securing means. The advantage of this is that the hair extension element and the strand of hair are guided parallel to each other through the holding member, which means that the hair extension element follows the direction of the strand of hair and the hair element extends continuously with respect to the strand of hair. Especially, in case of a hair extension in the form of an artificial strand of hair this causes an appropriate hanging thereof.

Preferably, the through-hole of the holding member has a length which is larger than its diameter so as to create a strong connection between the holding member and the strand of hair. Furthermore, the holding member may have an elongated shape, but a holding member being spherically-shaped, plate-shaped or ring-shaped is conceivable, as well.

The securing means may be elements which have undergone plastic deformation, and may be applied around the hair extension element at both sides of the through-hole. This is a simple securing method, but of course sticking of the hair extension element to the holding member or an alternative securing technique is conceivable.

In an alternative embodiment the holding member may be coupled to several holding members, each of them being provided with a through-hole, wherein the through-holes are positioned with respect to each other such that they extend substantially parallel to each other. This embodiment provides the possibility to connect several strands of hair, which extend more or less parallel to each other, to the holding members. In case that this embodiment is installed in the hair of a person, a type of horizontal base for holding members can be created in the hair, for example, to which base several hair extension elements may for example be attached. One may think of installing a rug of hair or a hair piece.

In an alternative embodiment the hair extension element comprises a supporting element for supporting ornaments. A part of the supporting member is guided through the through-hole, whereas another part is located outside of the holding member. Ornaments can be suspended from the part of the supporting member located outside the holding member. In practice, the supporting member preferably has a ring shape since ornaments suspended from that can be lost less easily. Therefore, the ring is partly surrounded by the holding member in this case.

The invention also relates to a method of connecting a hair extension element to a strand of hair by stringing a holding member to the strand of hair and securing the hair extension element to the holding member. The hair extension element is secured to the holding member before the holding member is stringed to the strand of hair. As a consequence, the act of installing the hair extension element in the hair is facilitated.

The invention also relates to a holding member for stringing in hair, which holding member is made of an elastic material and which is provided with at least an ornament. The holding member is characterized in that it includes at least two through-holes extending substantially parallel to each other for guiding strands of hair thereto. As a consequence, a stable connection between the holding member and the strands of hair will be created. As a consequence of the presence of the at least two through-holes, the risk of turning of the holding member about the strands of hair is decreased, such that the position of the holding member with respect to the hair is maintained well. As a result the visibility of the ornaments applied to the holding member is maintained better, for example.

The invention also relates to a holding member for stringing in hair, which is provided with at least a through-hole and which is made of an elastic material wherein at least two ornaments are provided on the outer side of the holding member.

The holding member can have a flat shape having at least one large side onto which the ornaments are provided. In general the flat-shaped holding member will have a smaller height than the length and width of the circumferential surface of the large side. The flat-shaped holding member can be a plate-shaped holding member of flexible material, for example, such as a silicon. The plate-shaped holding member may have several shapes, such as rectangular-, circular-, flower-, butterfly-shaped and numerous alternative shapes. The advantage of the flat shape is that this is kept stable in the hair, since it does not tend to rotate, which could result in a situation in which the ornaments could turn such that they face the head of a person. For example, it appears that compared to a hair pin on which an ornament of a similar shape has been applied, the flat-shaped holding member as described hereinbefore is kept in the hair more stable after some movements of the head. It even appears that the holding member is suitable for applying in relatively short hair.

In order to keep the weight of the holding member low the flexible material preferably has a low density. The flat shape and the flexibility of the material also have the advantage that it is more safe, because the risk of damage of the head skin at the location of the holding member, for example when bumping or falling, is limited. Any sharp ornaments can not rotate to the head skin because of the stable flat shape which means that any injuries are prevented. Of course, the holding member does not have sharp edges at the side facing the head skin.

The flat-shaped holding member may be provided with at least a projection in which the through-hole is provided. The projection can be assembled to the holding member as a separate part or may be integrated therein, and/or may be disposed at the opposite side of the large side on which the ornaments have been applied. The projection may have an elongated shape or several projections including through-holes may be applied, wherein the through-holes are aligned. However, it is also conceivable that the through-hole is provided in the flat-shaped holding member itself.

The ornaments may be applied onto two opposite sides. In this embodiment in any case an ornament is kept visible, even in case of possible rotation of the holding member with respect to the strand of hair.

The invention also relates to a holding member for stringing in hair, which is provided with at least a through-hole and which is made of an elastic material, wherein a supporting element, for example a ring, is provided through the through-hole for suspending ornaments there from, wherein the holding member is flexible such that and the supporting element is shaped such that remaining portion of the through-hole may guide a strand of hair and the holding member may clamp the guided strand of hair.

DESCRIPTION OF THE DRAWINGS

The invention will be elucidated further by means of drawings, which show embodiments of the invention.

DETAILED DESCRIPTION

Figure 1:
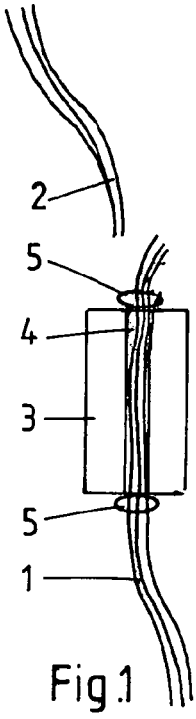
FIG. 1 is a sectional view of an embodiment of a hair extension element according to the invention.

FIG. 1 shows an embodiment of a hair extension element 1 for extending a-strand of hair 2. Such a hair extension element 1 generally serves to decorate the hair of a person, but other fields of application, such as hair of animals, are conceivable of course.

The hair extension element 1 is securable to the strand of hair 2 through a flexible holding member 3. The holding member 3 includes a through-hole 4 for guiding and clamping the strand of hair 2. According to the invention the holding member 3 and the hair extension element 1 are integrated so as to enable to install the hair extension element 1 integral on the strand of hair 2. The holding member 3 as shown in FIG. 1 has an elongated shape and the length of the through-hole 4 is larger than its diameter. Of course, many other shapes are conceivable. The application of such a holding member 3 to a strand of hair 2 is known in the art and is applied by means of a stringing tool or beading tool (an example of such a stringing tool is disclosed in the German Utility Model DE 29811599 U1).

In the embodiment as shown in FIG. 1 the hair extension element 1 in the form of an artificial strand of hair is guided through the through-hole 4 and fixed with respect to the holding member 3. In order to achieve this, securing means 5 in the form of elements which have undergone plastic deformation are applied to the hair extension element 1, such as clamping rings which are arranged about the hair extension element 1 at both sides of the through-hole 4. Since the hair extension element 1 is guided through the through-hole 4 the element 1 and the strand of hair 2 will be aligned after installing the element to a strand of hair 2. As a result the hair extension element 1 will hang well. Instead of using clamping rings threads which are wound firmly about the hair extension element 1 may be used. Furthermore, the hair extension element 1 could be attached to the holding member by an adhesive.

The hair extension element 1 can be made of one or more threads, fibers, strings or genuine human hair or artificial hair. In case of a strand of hairs or artificial hairs the own genuine hair of a person may be decorated and/or made full or gorgeous by applying the hair extension element 1.

Figure 2:
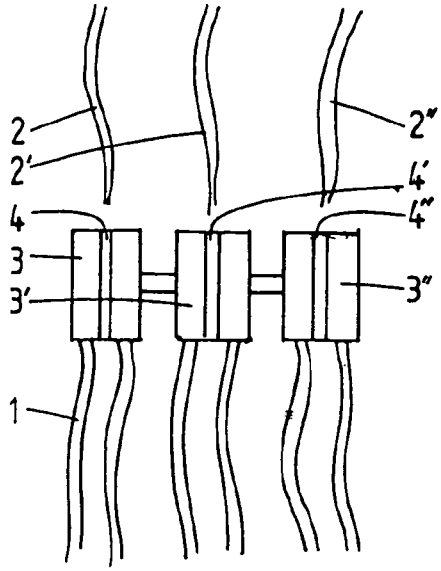
FIG. 2 is a sectional view of an alternative embodiment of a hair extension element according to the invention, wherein the holding member is connected to several holding members.

FIG. 2 shows an alternative embodiment of a hair extension element 1. In this case the holding member 3 is coupled to several holding members 3' and 3". In the embodiment as shown only two additional holding members 3' en 3" are applied, but this number may be varied from one to an arbitrary number. Each of the holding members 3, 3', 3" is provided with a through-hole 4, 4' and 4". The through-holes 4, 4' and 4" are positioned with respect to each other in such a way that they extend parallel to each other. As a result the holding members 3, 3' and 3" which are coupled to each other can be connected to several respective strands of hair 2, 2' and 2". When this embodiment is installed in the hair of a person, for example, a hair extension element 1 having a wide shape can be applied.

Figure 3:
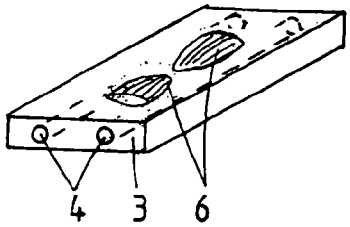
FIG. 3 is a perspective view of an embodiment of a holding member according to the invention.

FIG. 3 shows an embodiment of a holding member 3 for stringing in hair. It is made of an elastic material and is provided with two ornaments 6 on one outer side of the holding member 3. The holding member 3 comprises two through-holes 4 extending substantially parallel to each other for guiding strands of hair 2 through those. This embodiment can be stringed on strands of hair by means of a stringing tool in the same way as mentioned hereinbefore. The advantage of this embodiment of the holding member 3 is that it is kept stable in the hair, since it is secured to two strands of hair 2. Although FIG. 3 shows an embodiment including only two through-holes 4, several through-holes 4 are also conceivable in this case. Possibly the holding member 3 is provided with hair extension means.

Figure 4:
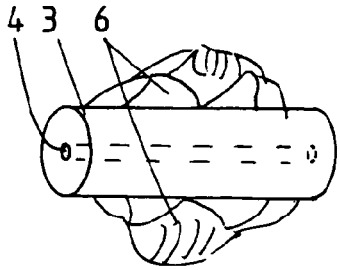
FIG. 4 is a perspective view of an alternative embodiment of a holding member according to the invention.

FIG. 4 shows an alternative embodiment of a holding member 3. In this embodiment the holding member 3 is provided with a single through-hole 4, and two ornaments 6 are provided on two opposite outer sides of the holding member 3. In this case the holding member 3 could have a flat shape, such as is shown in FIG. 3. On one large side thereof several ornaments 6 may be applied.

Figure 5:
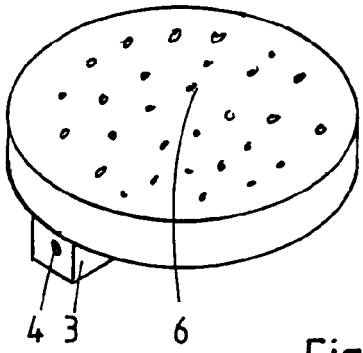
FIG. 5 is a perspective view of a further alternative embodiment of a holding member according to the invention.

FIG. 5 shows an embodiment of a holding member 3 having a flat shape, wherein a number of ornaments 6 are provided on a large surface thereof. In this embodiment the flat shape has an oval circumferential shape, but numerous alternative shapes are conceivable. The through-hole 4 for guiding a strand of hair through it is provided in an elongated projection which is applied on the holding member 3. This projection may comprise several projections extending behind each other, each including a through-hole, which through-holes are aligned.

Figure 6:
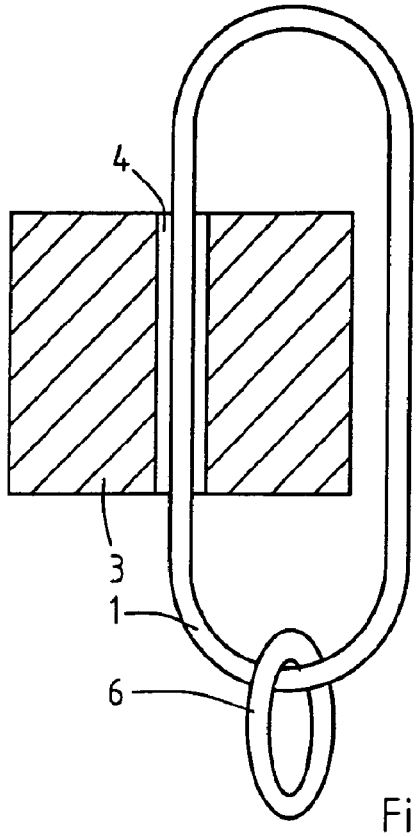
FIG. 6 is a similar view as FIG. 1 on enlarged scale and shows an alternative embodiment of a hair extension element.

FIG. 6 shows an alternative embodiment of a hair extension element 1. In this case the own genuine hair of a person is not extended by artificial hair, but the hair extension element 1 comprises a supporting element in the form of a ring. Ornaments 6 can be suspended from the ring such that the ring basically functions as a supporting element for ornaments. The ring 1 is applied through the through-hole 4 of the holding member 3. This can be achieved, for example, by moving the holding member 3 through an open portion of the ring and sliding it over the ring via its through-hole 4 and subsequently clamping the ring such that a closed ring 1 arises, as shown in FIG. 1. As a consequence of the flexibility of the elastic material of the holding member 3 a strand of hair 2 can be guided through and clamped in the through-hole 4 together with the ring 1. The advantage of this construction is that the ring 1 uses the same through-hole 4 as the strand of hair 2 which is guided through the through-hole 4. If the ring 1 would have been integrated in the material of the holding member 3 separately a complex manufacturing process such as molding it into that material would have been required, and the wall thickness of the holding member 3 at that location should have been designed thicker.

Figure 7:
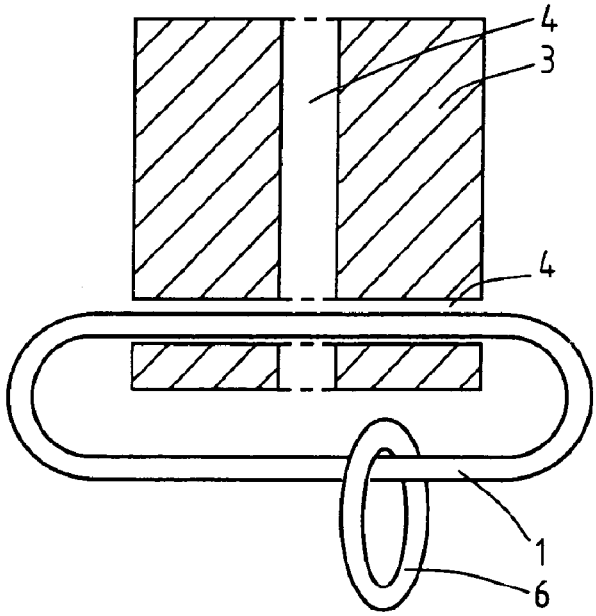
FIG. 7 is a similar view as FIG. 6, showing an alternative embodiment.

FIG. 7 shows another alternative embodiment of a hair extension element 1. In this embodiment the ring 1, being the extension element, is positioned in a different way in the holding member 3. More specifically, a leg of the ring extends perpendicularly to the trough-hole 4. Furthermore, an ornament 6 in the form of a second ring is suspended from the ring 1. It will be clear that the ring 1 may be positioned in the holding member 3 in numerous alternative ways.

From the foregoing it will be apparent that the invention provides a hair extension element and a holding member, which can be secured to a strand of hair in a relatively simple way.

The invention is not limited to the embodiments as shown in the drawings and described hereinbefore which can be varied in several ways within the scope of the invention. For example, it is possible to use a single common base comprising several holding members coupled to each other, which include through-holes extending parallel to each other instead of several holding members each including a through-hole which are coupled to each other. Furthermore the hair extension element itself may be provided with stringable elements.

The invention claimed is:

1. A hair extension for extending a strand of hair, which is securable to the strand of hair, comprising:

a hair extension element;

an elastic holding member, wherein the holding member comprises a through hole with a length for receiving and clamping the strand of hair being guided through the through hole;

wherein the hair extension element is secured in the holding member by a set of plastically deformed elements, wherein at least one plastically deformed element from the set of plastically deformed elements is applied to the hair extension element at each side of the through hole; and wherein the holding member and the hair extension element are integrated so as to provide the hair extension as a single element to receive the strand of hair, the hair extension element extending through the through hole and provided adjacent to the strand of hair received within the holding member.

2. A hair extension according to claim 1, wherein the holding member has an elongated shape and wherein the length of the through hole is larger than its diameter.

3. A hair extension according to claim 1, wherein the hair extension element is made of one or more threads, fibers, strings or genuine hair or artificial hair.

4. A hair extension according to claim 1, wherein the holding member is coupled to several holding members, which are each provided with a through hole, wherein the through holes are positioned with respect to each other such that they extend substantially parallel to each other.

* * * * *